US005169350A

United States Patent [19]

Tsujii

[11] Patent Number: 5,169,350

[45] Date of Patent: Dec. 8, 1992

[54] TILT DEVICE FOR A MARINE PROPULSION UNIT

[75] Inventor: Eiichiro Tsujii, Hamamatsu, Japan

[73] Assignee: Sanshin Kogyo Kabushiki Kaisha, Hamamatsu, Japan

[21] Appl. No.: 713,389

[22] Filed: Jun. 11, 1991

[30] Foreign Application Priority Data

Jun. 15, 1990 [JP] Japan ..... 2-155450

[51] Int. Cl.[5] ..... B63H 21/26

[52] U.S. Cl. ..... 440/61; 248/642; 440/63

[58] Field of Search ..... 248/640, 641, 642; 440/49, 52, 61, 63, 900; 114/355, 356, 357

[56] References Cited

U.S. PATENT DOCUMENTS 4,354,848 10/1982 Hall et al. ..... 440/61
4,362,513 12/1982 Hall et al. ..... 440/61
4,673,358 6/1987 Iwai et al. ..... 440/63
4,682,961 6/1987 Nakahama ..... 440/63
4,781,631 11/1988 Uchida et al. ..... 440/61
4,813,897 3/1989 Newman et al. ..... 440/61
4,836,811 6/1989 Griffiths et al. ..... 440/61
4,931,027 6/1990 Nakahama et al. ..... 440/63

*Primary Examiner*—Galen Barefoot
*Assistant Examiner*—Stephen P. Avila
*Attorney, Agent, or Firm*—Ernest A. Beutler

[57] ABSTRACT

A mounting arrangement is provided for mounting an outboard drive for movement between a tilted down position through trim adjusted positions to a tilted up out of the water position. The arrangement includes a quadrilateral linkage system and a hydraulic motor device which simultaneously lifts and tilts a motor relative to an associated watercraft. The invention allows the links employed in the linkage system to be constructed so that the cross-sectional areas along their lengthwise axes are greatest along their central regions, whereat they are pivotally connected together, and decreases towards each of their ends, thereby minimizing the weight of the arrangement.

24 Claims, 9 Drawing Sheets

TILT DEVICE FOR A MARINE PROPULSION UNIT

BACKGROUND OF THE INVENTION

This invention relates to a mounting arrangement for an outboard drive and more particularly to an improved mounting arrangement for mounting an outboard drive for movement between a tilted down position through trim adjusted positions to a tilted up out of the water position.

It is well known to mount marine outboard drives for movement relative to the transom of an associated watercraft between a plurality of trim adjusted positions so that the propeller will assume the appropriate driving position relative to the body of water in which it is operating and at the appropriate angle relative to the transom of the watercraft. It is further known to mount such outboard drive units for movement so that the propeller can be tilted up completely out of the water. The more conventional type of tilting arrangement mounts the outboard drive for pivotal movement about a single, horizontally disposed axis. Although such arrangements have the advantages of simplicity, when used in conjunction with outboard motors they tend to have the power head of the outboard motor encroach into the watercraft when the motor is tilted up. In addition, such single pivot axis supports do not always permit the propeller to be disposed at the optimum driving angle.

In order to overcome such disadvantages, tilting devices have been proposed which can tilt a propulsion unit while also lifting it at the same time. In such a conventional device, a fixed bracket, a tilt bracket supporting a propulsion unit and two links constitute a link mechanism which is operated by a hydraulic motor to perform lift and tilt operations simultaneously.

However, since the two links constituting the arrangement carry only compression and tension loads, the cross-sectional areas of the links have had to be quite large across their entire lengths in order to provide the necessary strength for adequate performance. Such a requirement has resulted in an undesirable heavy weight of the linkage arrangements.

It is, therefore, a principal object of this invention to provide an improved tilt and trim arrangement for an outboard marine propulsion unit.

It is further an object of this invention to provide a tilt and trim arrangement capable of simultaneously lifting and tilting an outboard drive unit.

It is still a further object of this invention to provide a lift and tilt arrangement of reduced weight compared to previous arrangements.

SUMMARY OF THE INVENTION

This invention is adapted to be embodied in a supporting arrangement for suspending a marine outboard drive from the transom of an associated watercraft for movement from a tilted down running condition to a tilted up out of the water condition. The supporting arrangement comprises a first element adapted to be affixed to an associated watercraft and a second element carrying a propulsion device. A first link is provided along with means for pivotally connecting the first link to the first element at a first pivot axis fixed relative to the first element. Further, means are provided for pivotally connecting the first link to the second element at a second pivot axis fixed relative to the second element. A second link is also provided along with means for movably supporting a first portion of the second link relative to the first element. Further, means are provided for connecting a second portion of the second link to the second element. Means are additionally provided for pivotally connecting the first and second links together.

DETAILED DESCRIPTION OF THE PREFERRED EMBODIMENTS

Figure 1:
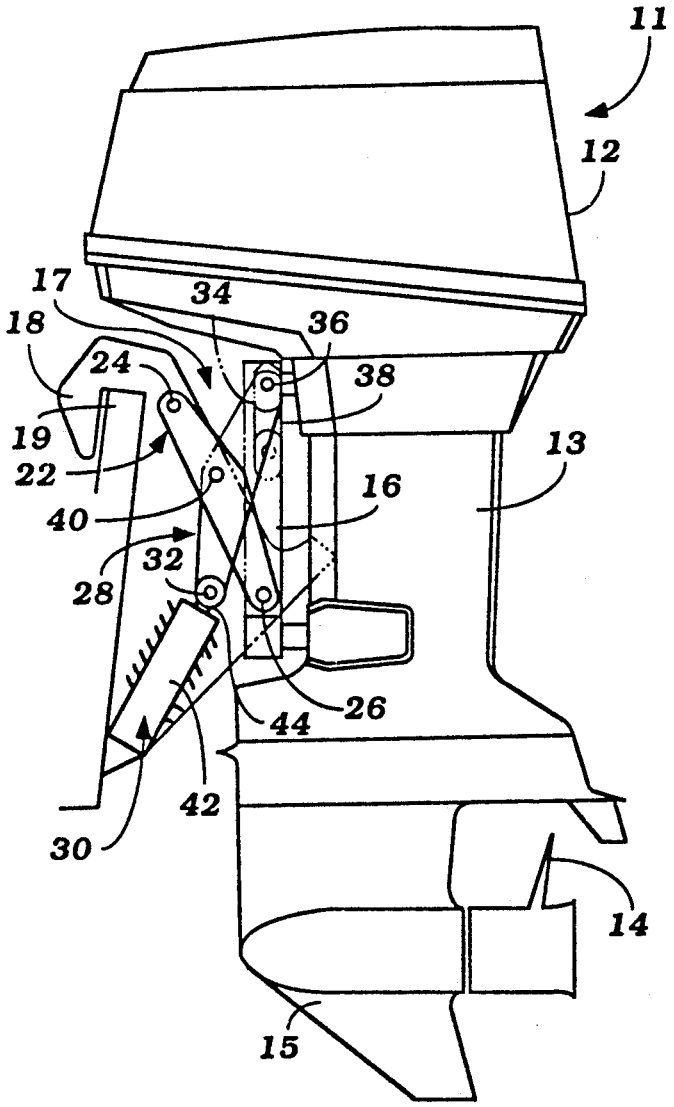
FIG. 1 is a side elevational view of an outboard motor suspended from an associated watercraft in a manner in accordance with a first embodiment of the invention.

In FIG. 1, an outboard motor suspended in accordance with a first embodiment of the invention is identified generally by the reference numeral 11. Although the invention is particularly adapted for use with outboard motors, it is to be understood that it is capable of being utilized with the outboard drive unit of an inboard-outboard drive arrangement. For this reason, the term "outboard drive" as used in the specification and claims is intended to encompass outboard motors or the outboard drive unit of such an inboard-outboard arrangement. The outboard motor 11 includes a power head 12 consisting of a protective cowling and an internal combustion engine. The engine of the power head 12 drives a drive shaft that extends through a drive shaft housing 13 and which drives a propeller 14 supported by a lower unit 15 in a suitable manner, as through a conventional forward, neutral, reverse transmission. Inasmuch as the details of the construction of the outboard motor 11 per se form no part of the invention, the internal details of the outboard motor 11 have not been illustrated and will not be described.

Figure 2:
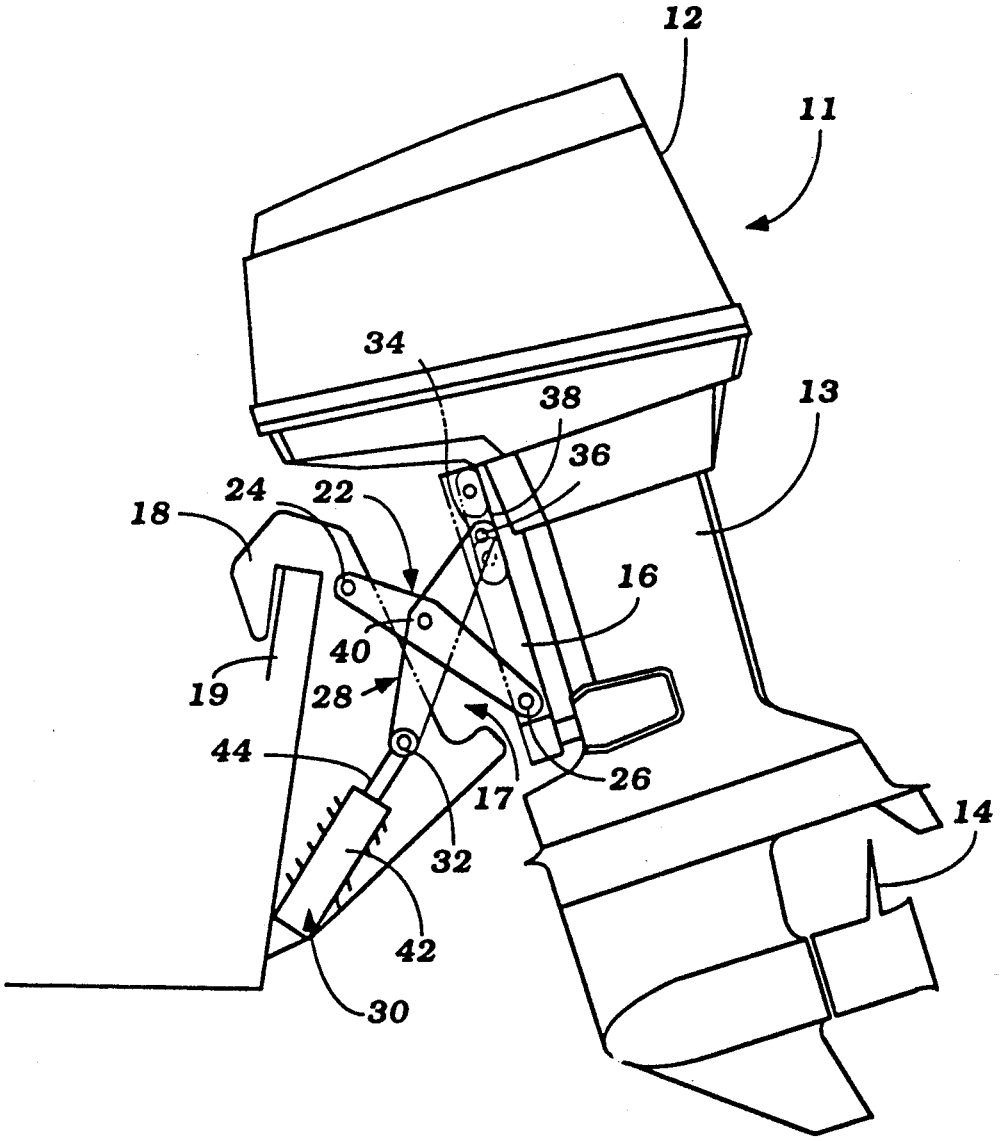
FIG. 2 is a side elevational view showing the embodiment of FIG. 1 in a trimmed up condition.
Figure 3:
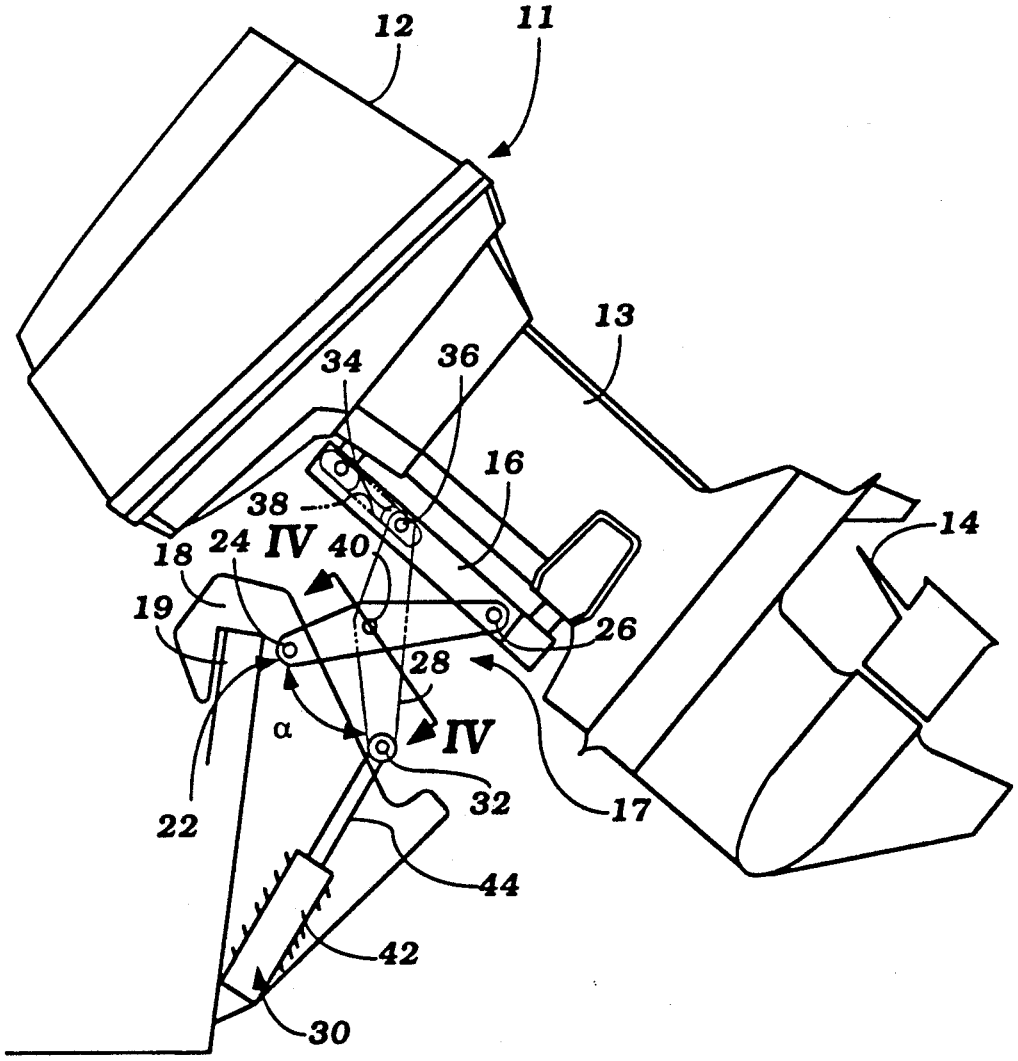
FIG. 3 is a side elevational view showing the embodiment of FIG. 1 in a tilted up condition.

A steering shaft (not shown) is affixed to the drive shaft housing 13 and is journaled within a swivel bracket assembly 16 for steering movement of the outboard motor 11 about a vertically extending steering axis A quadrilateral linkage construction, indicated generally by the reference numeral 17 is provided for supporting the outboard motor Il for movement relative to the transom bracket 18 that is affixed to a transom 19 of an associated watercraft. The linkage assembly 17 permits movement of the outboard motor 11 from a fully tilted down condition, as shown in FIG. 1, to a trimmed up condition, as shown in FIG. 2, and on to a fully tilted up condition, as shown in FIG. 3.

The quadrilateral linkage assembly 17 of the first embodiment includes a first link 22 pivotally connected at its forward end to the transom bracket 18 by means of a pivot pin 24 for pivotal movement about a first pivotal axis. The rear or trailing end of the link 22 is pivotally connected to the swivel bracket 16 by means of a pivot pin 26 for pivotal movement about a second pivot axis. In this embodiment, the link 22 is rigid and inextensible.

A second link, indicated generally by the reference numeral 28, is pivotally connected at its forward end to the transom bracket 18, through a hydraulic motor 30, by means of a pivot pin 32 for pivotal movement about a third pivot axis. The hydraulic motor 30 is held in a fixed position on the transom bracket 18 by any suitable means, for example by way of welds. The rear end of the second link 28 is pivotally connected to a rider element 34 through a pivot pin 36 for pivotal movement about a fourth axis. The rider element 34 is slidably disposed within a slide groove 38 located along an upper region of the swivel bracket 16.

The first and second links 22 and 28 are additionally pivotally connected together by a pivot pin 40 at a position where their lengthwise axes cross, for pivotal movement about a fifth pivot axis.

The hydraulic motor 30 comprises, in part, a cylinder 42 which houses a reciprocally moveable piston rod 44. An eyelet is provided at the end of the piston rod, through which the pivot pin 32 is passed in order to form the pivotable connection with the forward portion of the second link 28. Thus, this portion of the second link 28 is reciprocally moveable along a line with respect to the transom bracket 18.

FIGS. 2 and 3 show the piston rod 44 extended to provide a trimming operation and a tilting up operation, respectively. As shown in the FIGS. 1 through 3, the rear end of the second link 28 moves along the slide groove 38 with movement of the piston rod 44 out of the fixed cylinder 42. In FIG. 1 the motor 11 is fully tilted down. In this condition, the piston rod 44 is essentially fully withdrawn into the cylinder 42, except for the eyelet portion holding the pivot pin 32. Furthermore, the rider element 34, holding the pivot pin 36, is positioned at an uppermost portion of the slide groove 38. In FIG. 2 the motor 11 is trimmed up. In this condition, the piston rod 44 extends partially out of the cylinder 42. Furthermore, the rider element 34, holding the pivot pin 36, is positioned midway along the slide groove 38. In FIG. 3 the motor is fully tilted up. In this condition, the piston rod 44 is fully extended out of the cylinder 42. Furthermore, the rider element 34, holding the pivot pin 36, is positioned at a lowermost portion of the slide groove 38.

Figure 4:
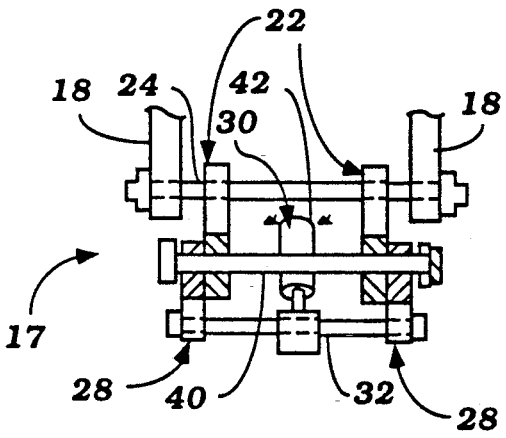
FIG. 4 is a cross-sectional view taken along the line IV—IV of FIG. 3.

FIG. 4 is a cross-sectional view taken along the line IV—IV of FIG. 3 showing the quadrilateral linkage assembly 17 as it extends across the width of the transom bracket 18.

Figure 5:
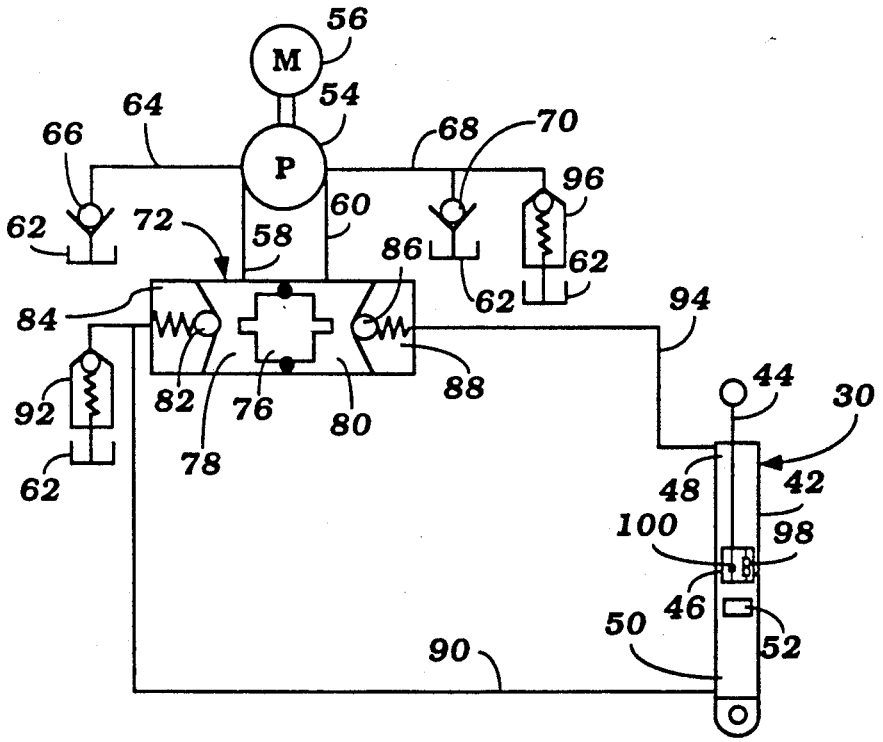
FIG. 5 is a partially schematic hydraulic circuit diagram for the hydraulic system of the mounting arrangement.

FIG. 5 is a partially schematic hydraulic circuit diagram for the hydraulic system of the mounting arrangement of the invention. The hydraulic motor 30 includes a cylinder 42 containing a piston 46 which is slidably supported within the bore of the cylinder 42 and divides it into an upper chamber 48 and a lower chamber 50. A floating piston 52 is positioned beneath the piston 46 and divides the lower chamber 50 into upper and lower portions. A piston rod 44 is affixed to the piston 46 and may extend outwardly beyond the cylinder housing 42. The upper end of the piston rod 44 is formed with an eyelet that is pivotally connected by means of the pivot pin 32 to the second link 28.

A reversible fluid pump 54 is driven by a reversible electric motor 56 that is controlled by an operator in a known manner. The pump 54 has a first port to which a port line 58 extends and a second port to which a port line 60 extends. The port served by the line 58 is also connected to a reservoir 62 by means of a line 64 and a check valve 66. In a similar manner, the port served by the line 60 is adapted to communicate with the reservoir 62 through a line 68 in which a check valve 70 is provided.

A shuttle valve assembly, indicated generally by the reference numeral 72 is provided with a floating piston 76 that defines first and second chambers 78 and 80 that communicate with the lines 58 and 60, respectively. A check valve 82 communicates the chamber 78 with a further chamber 84. In a like manner, a check valve 86 communicates the chamber 80 with still a further chamber 88.

The chamber 84 communicates with a line 90 that extends to the lower chamber 50 of the hydraulic motor 30, below its floating piston 52. A relief valve 92 is provided in the line 90 and is adapted to communicate fluid pressure back to the reservoir 62 under conditions as will be described. The chamber 88 communicates with a line 94 that extends to the upper chamber 48 of the hydraulic motor 30, above the piston 46. The hydraulic circuit further includes a relief line 96 that communicates the port line 60 with the reservoir 62.

A pressure responsive absorber valve 98 is provided in the piston 46 for permitting flow from the chamber 48 to the portion of the chamber 50 above the floating piston 52 if the outboard motor 11 strikes an underwater obstacle with sufficient impact. A relief valve 100 formed in the piston 46 permits flow in the opposite direction. The relief valve 100 opens at a substantially lower pressure than the absorber valve 98 and is responsive primarily to the weight of the outboard motor 11 so as to permit it to return to the normal trim adjusted position once the underwater obstacle is cleared.

When the motor 11 tilts or pops up, as when encountering an underwater obstacle, the floating piston 52 essentially remains stationary within the cylinder housing while the tilt piston moves in response to the upward force upon the engine 11. Thus, when the engine 11 lowers, for example by the weight of the engine or the forward force provided by the propulsion unit, the piston 46 lowers within the cylinder until it reaches the floating piston 52, whereat the piston 46 comes to rest. Accordingly, the floating piston 52 serves a memory function when the engine 11 pops up and then lowers, allowing the engine 11 to reassume its former tilted or trimmed position.

The operation of the device will now be described. If it is desired to effect trim up of the outboard motor 11, and this is normally done under running conditions, the motor 56 is energized so as to drive the pump 54 in a direction to pressurize the port line 58 and cause the port line 60 to act as a suction port.

Pressurization of the port line 58 causes the shuttle piston 76 to move to the right and one of its two projections engages the ball of the check valve 86 and unseats it to open communication between the chamber portions 80 and 88. Pressurization of the chamber port 78 generates sufficient pressure to unseat the ball of the check valve 82 and permit flow to occur from the chamber portion 78 to 84 and the line 90. Pressurization of the line 90 causes fluid to be delivered to the cylinder chamber portion 50 so as to urge its floating piston 52 and main piston 46 upwardly, thereby exerting an upward force on the piston rod 44.

When the cylinder piston 46 moves upwardly, fluid is displaced from the upper chamber 48 through the line 94 and into the shuttle valve chamber portion 88. Since the ball check valve 86 is unseated, this fluid may flow into the chamber portion 80 and back to the pump port line 60 so as to provide fluid to its suction side.

When the desired position is reached, the operator stops the motor 56 and the outboard motor 11 will be retained in the desired position by lockage of hydraulic fluid in the cylinder chamber portions 48 and 50.

If the motor 56 and pump 54 are continued to be driven in the direction so as to pressurize the port line 58, the motor 11 may be tilted up in the manner now to be described. Fluid further supplied to the line 90 will further urge the floating piston 52 and the piston 46 upwardly until the piston 100 reaches the upper end of its stroke. At this point the piston rod 44 will be fully extended out of the cylinder housing 42. If the motor 56 continues to be run, there will be a rise in the pressure in the line 90 and the relief valve 92 will open so as to return fluid to the reservoir.

Tilting down is achieved by operating the motor 56 so as to drive the pump 54 in a direction that the port line 60 is pressurized and the port line 58 acts as a suction port. Pressurization of the port line 60 causes fluid in the shuttle valve chamber portion 80 to cause the shuttle piston 76 to move to the left so that its other projection will engage the ball check valve 82 and unseat it so as to open communication between the chamber portions 78 and 84. Thus, the line 90 will be opened to the suction port line 58 of the pump 54.

Pressurization of the chamber 80 causes sufficient pressure to be generated so as to unseat the ball check valve 86 and open communication with the chamber portion 88. This pressurizes the line 94 and causes fluid to flow into the upper chamber 48 of the cylinder 42, thereby urging the piston 46 and the floating piston 52 downwardly. Fluid is expelled from the lower chamber 50 back to the suction port line 58 through the line 90 and chamber portions 84 and 78, past the opened check valve 82.

If the motor 56 continues to run in the tilt down condition once the pistons 46 and 52 have reached the limits of their travel, the pressure in the line 94 will rise abruptly and the relief valve 96 will open to cause fluid pressurized by the pump 54 to be returned to the reservoir 62 through the line 68.

Now, a second embodiment of the invention shall be described with reference to FIGS. 6, 7 and 8. Since many of the elements, and their operation, of the following embodiment are identical to that of the first embodiment, like reference numerals in the second embodiment indicate like elements as identified and explained in the first embodiment.

Figure 6:
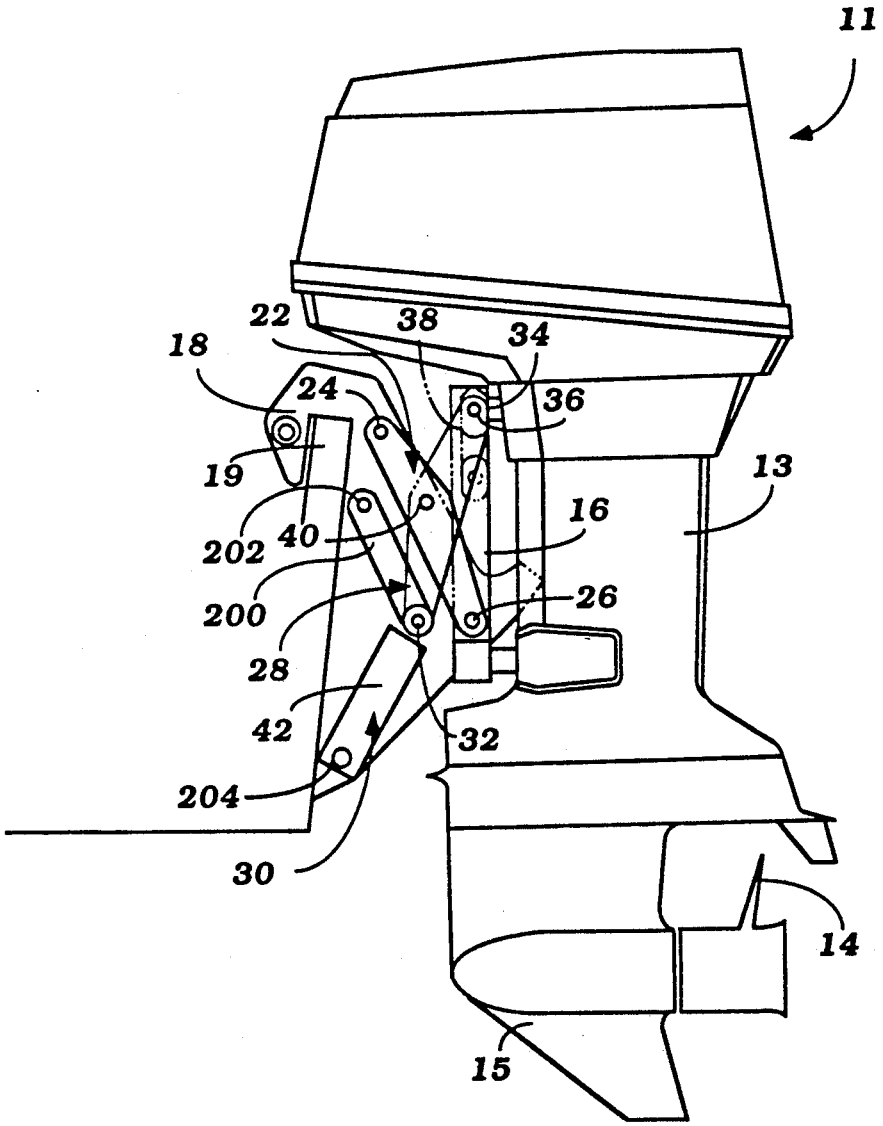
FIG. 6 is a side elevational view of an outboard motor suspended from an associated watercraft in a manner in accordance with a second embodiment of the invention.
Figure 7:
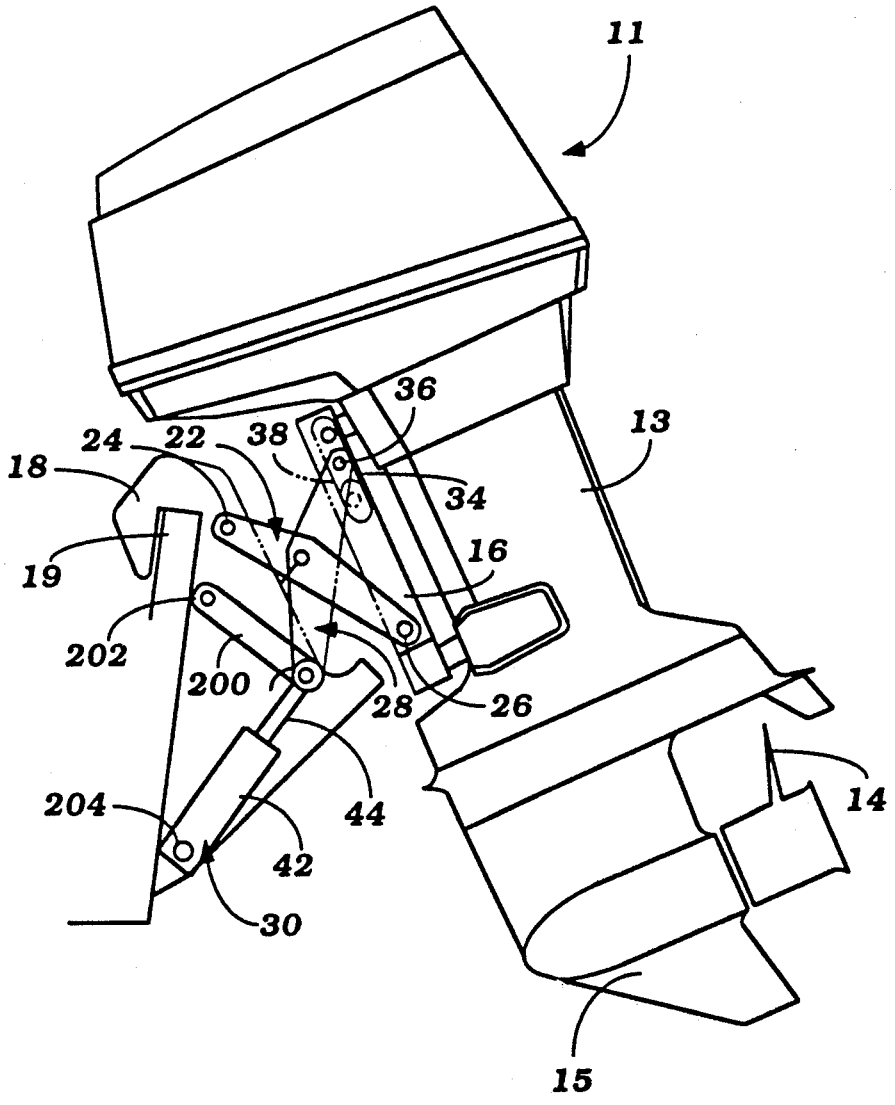
FIG. 7 is a side elevational view showing the embodiment of FIG. 6 in a trimmed up condition.
Figure 8:
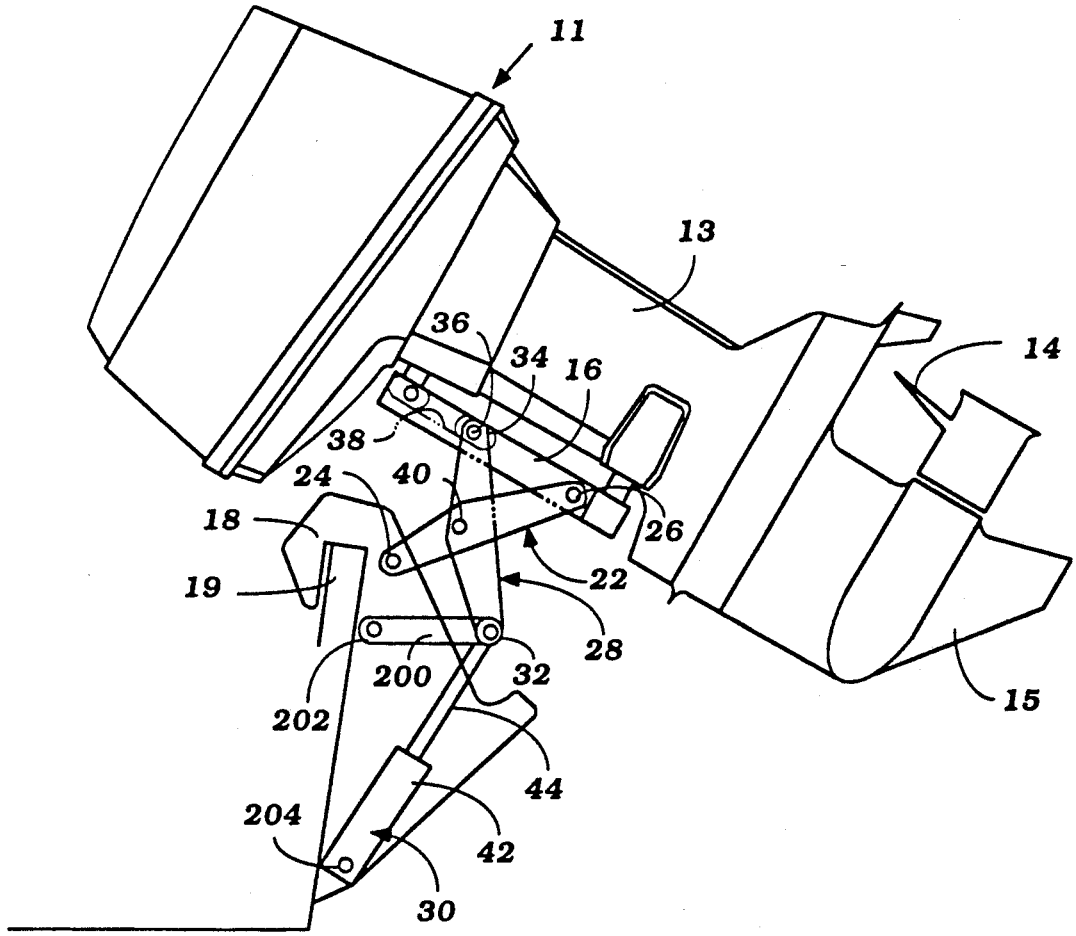
FIG. 8 is a side elevational view showing the embodiment of FIG. 6 in a tilted up condition.

As shown in FIGS. 6 through 8, an additional link 200 is provided in the second embodiment. The link 200 is pivotally attached at its forward end to the transom bracket 18 by way of a pivot pin 202 at a fifth pivot axis. The rear end of the link 200 is pivotally attached to the eyelet at the top of the piston rod 44, along with the forward end of the link 28, by way of the pivot pin 32 about the third pivot axis. Further, in the second embodiment, the cylinder 30 is pivotally attached to the lower portion of the transom bracket 18, by way of a pivot pin 204 about a sixth pivot axis. Accordingly, as the engine moves from its fully tilted down position to its fully tilted up position, the link 200 restricts the movement of the lower portion of the link 28 to a specific predetermined path.

Figure 9:
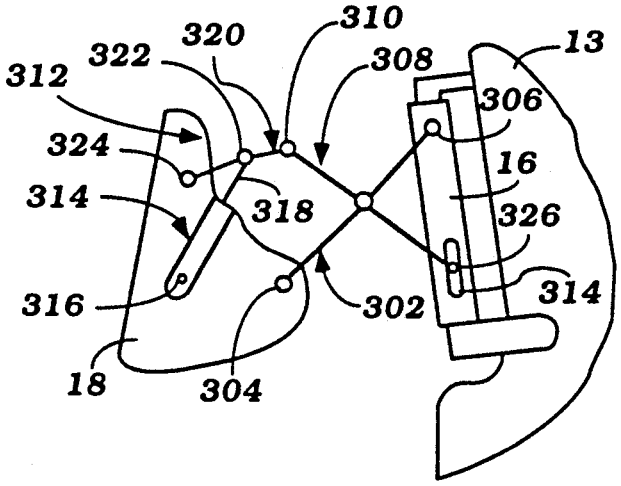
FIG. 9 is a partially schematic view showing another linkage arrangement which is employed in a third embodiment of the invention.

FIG. 9 illustrates a third embodiment of the invention. A first link 302 is pivotally connected to the transom bracket 18 about a first pivot axis 304. The first link 302 is pivotally connected to the swivel bracket 16 about a second pivot axis 306.

A second link 308 is pivotally connected to the transom bracket 18 at a third pivot 310 axis through an arrangement, generally denoted by the reference numeral 312, which allows reciprocal movement of the third pivot axis 310, along a predetermined path with respect to the transom bracket 18.

The arrangement 312 comprises a hydraulic motor 314 pivotally connected to the transom bracket 18 about an axis 316 at its lower end, and having a reciprocally moveable piston rod 318 extensible from its upper end. The piston rod 318 is pivotally connected at its upper end at a point along the length of an additional link 320 about an axis 322. The link 320 is an inextensible linear member pivotally attached at its forward end to the transom bracket 18 about an axis 324, and pivotally connected at its rear end to the second link at the third pivot axis 310.

The rear end of the second link 308 is pivotally connected to a rider element through a pivot pin for pivotal movement about a fourth axis 326. The rider element is slidably disposed within a slide groove located along a lower region of the swivel bracket 16.

In each of the three embodiments set forth above, the two links employed are pivotally connected together at a position where their lengthwise axes cross. Propeller thrust is thus transmitted to the boat by way of both axial and bending loads exerted upon the links, and not just through axial loads as with many past arrangements. Accordingly, the links are only required to possess a larger moment of inertia at the regions proximate to their pivotal connection where a large bending moment is incurred. It is therefore unnecessary to provide a large crosssectional area along the entire lengths of the links. As a result, a tilting and lifting arrangement having a relatively light weight is achieved.

Although several embodiments of the invention have been illustrated and described, various changes and modifications may be made without departing from the spirit and scope of the invention, as defined by the appended claims.

It is claimed:

1. A supporting arrangement for suspending a marine outboard drive from a transom of an associated watercraft for movement from a tilted down running condition to a tilted condition, comprising: a first element adapted to be affixed to an associated watercraft and a second element carrying a propulsion device; a first link and means pivotally connecting said first link to said first element at a first pivot axis fixed relative to said first element; means pivotally connecting said first link to said second element at a second pivot axis fixed relative to said second element; a second link and means movably supporting a first portion of said second link relative to said first element; means for connecting a second portion of said second link to said second element; wherein said first and second links each include a lengthwise axis having a generally centrally located portion and two end portions, and comprising a point whereat said generally centrally located portions cross one another and, further comprising, means for pivotally connecting said first and second links to one another at said point whereat said generally centrally located portions cross.

2. A supporting arrangement as set forth in claim 1 wherein said first link has a varying cross-sectional area along its lengthwise axis, and wherein said second link has a varying cross-sectional area along its lengthwise axis; and wherein the cross-sectional area along the lengthwise axis of each of said first and second links is greatest along their generally centrally located portions, whereat they are pivotally connected together, and decreases towards each of their respective end portions.

3. A supporting arrangement as set forth in claim 1 wherein said first portion of said second link is pivotally connected to said first element through a third pivot axis, and further comprising means for moving said third pivot axis back and forth relative to said first element along a desired path.

4. A supporting arrangement as set forth in claim 3 wherein said path of back and forth movement of said third pivot axis is along a line.

5. A supporting arrangement as set forth in claim 3 wherein said path of back and forth movement of said third pivot axis is along a curve.

6. A supporting arrangement as set forth in claim 3 wherein said second portion of said second link is pivotally connected to said second element at a fourth pivot axis, and further comprising means for moving said fourth pivot axis back and forth relative to said second element along a desired path.

7. A supporting arrangement as set forth in claim 6 wherein said path of back and forth movement of said fourth axis is along a line.

8. A supporting arrangement as set forth in claim 6 wherein said means for moving said fourth pivot axis back and forth relative to said second element comprises a groove located within said second element in a direction substantially parallel to a line running lengthwise through said outboard drive; and a rider element slidably disposed within said groove and within which said fourth pivot axis is formed.

9. A supporting arrangement as set forth in claim 8 wherein said means for moving said third pivot axis back and forth relative to said first element comprises a hydraulic device.

10. A supporting arrangement as set forth in claim 9 wherein the hydraulic device comprises a hydraulic motor.

11. A supporting arrangement as set forth in claim 10 wherein the hydraulic motor includes a cylinder and a piston, said cylinder mounted upon said first element and being fixed relative to said first element; and said piston located within said cylinder and adapted for reciprocal movement therein; and a variably positionable piston rod, said piston rod adapted for movement with said piston from a position substantially within said cylinder to a position substantially extended outside of said cylinder.

12. A supporting arrangement as set forth in claim 11 wherein said pivotal connection of said second link to said first element through said third pivot axis comprises an eyelet positioned at an outer end of said piston rod and an eyelet positioned at an end of said second link, said eyelets adapted to receive a pivot pin therethrough thereby pivotally connecting said second link and said end of said piston rod.

13. A supporting arrangement as set forth in claim 12 further including shock absorbing means in said hydraulic motor for permitting the outboard drive to pop up in response to striking an underwater obstacle.

14. A supporting arrangement as set forth in claim 10 wherein the hydraulic motor includes a cylinder and a piston, said cylinder pivotally mounted at its lower end upon said first element; and said piston located within said cylinder and adapted for reciprocal movement therein; and a variably positionable piston rod, said piston rod adapted for movement with said piston from a position substantially within said cylinder to a position substantially extended outside of said cylinder.

15. A supporting arrangement as set forth in claim 14 further comprising a third inextensible link adapted to be pivotally connected at one of its ends to said first element at a fifth pivot axis fixed relative to said first element and positioned between said first pivot axis and said pivot axis of said lower end of said cylinder located upon said first element; said third link adapted to be pivotally connected at its other end at said third pivot axis.

16. A supporting arrangement as set forth in claim 15 wherein said pivotal connection of said second link to said first element through said third pivot axis comprises an eyelet positioned at an outer end of said piston rod and an eyelet positioned at an end of said second link, said eyelets adapted to receive a pivot pin therethrough pivotally connecting said second link and said end of said rod.

17. A supporting arrangement as set forth in claim 16 further including shock absorber means in said hydraulic motor for permitting the outboard drive to pop up in response to striking an underwater obstacle.

18. A supporting arrangement as set forth in claim 8 wherein said pivotal connection of said second link to said first element at said third pivot axis comprises a third link pivotally connected at one end to said first element and pivotally connected at its other end to said second link at said third pivot axis; and a hydraulic motor pivotally connected at one end to said first element and pivotally connected at its other end at a point along said third link.

19. A supporting arrangement as set forth in claim 18 wherein said means for moving said third pivot axis back and forth relative to said first element comprises said third link pivotally connected at one end to said first element and pivotally connected at its other end to said second link at said third pivot axis; and said hydraulic motor pivotally connected at one end to said first element and pivotally connected at its other end at said point along said third link.

20. A supporting arrangement as set forth in claim 19 wherein said hydraulic motor includes a cylinder and a piston, said cylinder pivotally mounted at its lower end upon said first element; and said piston located within said cylinder and adapted for reciprocal movement therein; and a variably positionable piston rod, said piston rod adapted for movement with said piston from a position substantially within said cylinder to a position substantially extended outside of said cylinder; said piston rod pivotally connected to said point along said third link.

21. A supporting arrangement as set forth in claim 20 further including shock absorbing means in said hydraulic motor for permitting the outboard drive to pop up in response to the striking of an underwater obstacle.

22. A supporting arrangement for suspending a marine outboard drive from a transom of an associated watercraft for movement from a tilted down running condition to a tilted up condition comprising a first element adapted to be affixed to an associated watercraft and a second element carrying a propulsion device; a first link and means pivotally connecting said first link to said first element at a first pivot axis fixed relative to said first element; means pivotally connecting said first link to said second element at a second pivot axis fixed relative to said second element; a second link and means movably supporting a first portion of said second link relative to said first element; means for connecting a second portion of said second link to said second element; and, means for pivotally connecting said first and second links together; wherein said supporting arrangement includes a single hydraulic device actuating said movement of said marine outboard drive.

23. A supporting arrangement as set forth in claim 22 wherein said first link has a lengthwise axis including a central region and two end portions, and wherein said second length has a lengthwise axis including a central region and two end portions; and wherein said pivotal connection between said first and second links is located at a position whereat said central regions of said lengthwise axes of said first and second links cross one another.

24. A supporting arrangement as set forth in claim 23 wherein said first link has a varying cross-sectional area along its lengthwise axis, and wherein said second link has a varying cross-sectional area along its lengthwise axis; and wherein the cross-sectional area along the lengthwise axis of each of said first and second links is greatest along their central regions, whereat they are pivotally connected together, and decreases towards each of their respective end portions.

* * * * *